US005971650A

United States Patent [19]

Dottel

[11] Patent Number: 5,971,650

[45] Date of Patent: Oct. 26, 1999

[54] FILING DEVICE FOR DOCUMENTS AND METHOD OF MANUFACTURING SUCH DEVICE

[75] Inventor: Jean-Marc Dottel, Valenciennes, France

[73] Assignee: Achat et Distribution d'Articles de Classement "A D Classment", Valenciennes, France

[21] Appl. No.: 08/982,698

[22] Filed: Dec. 2, 1997

[51] Int. Cl.[6] ..... B42F 13/00

[52] U.S. Cl. ..... 402/73; 281/19.1; 281/28; 281/37; 281/51; 402/77

[58] Field of Search ..... 281/29, 19.1, 20, 281/28, 37, 51; 402/73, 77

[56] References Cited

U.S. PATENT DOCUMENTS

| | | | |
|---|---|---|---|
| 4,315,632 | 2/1982 | Errichiello | 402/73 |
| 4,445,799 | 5/1984 | Wright et al. | 402/73 |
| 4,865,483 | 9/1989 | Snook | 283/38 |
| 5,174,674 | 12/1992 | Norwood | 402/73 |
| 5,407,230 | 4/1995 | Brink et al. | 281/21.1 |
| 5,575,504 | 11/1996 | Wagner | 402/73 |

FOREIGN PATENT DOCUMENTS

| | | | |
|---|---|---|---|
| 431453 | 2/1963 | Germany | 281/37 |

*Primary Examiner*—Andrea L. Pitts
*Assistant Examiner*—Monica Smith
*Attorney, Agent, or Firm*—Harrison & Egbert

[57] ABSTRACT

A filing device for documents having a panel of material with a spine and first and second lateral faces extending therefrom. The panel is a planiform hollow shell construction. Flaps are formed on the distal edges of the lateral faces. One of the flaps has a hook member formed within cut-out portion. The other flap has a cut-out portion with a slit formed at bottom thereof. The slit is suitable for receiving the hook member. The hook member is hingedly connected to the flap at the bottom of the cut-out portion.

9 Claims, 4 Drawing Sheets

FILING DEVICE FOR DOCUMENTS AND METHOD OF MANUFACTURING SUCH DEVICE

TECHNICAL FIELD

The present invention relates to a filing device, in particular for documents, such as sheets or pages, or others, possibly perforated, as well as to a process for the manufacture of such a filing device.

BACKGROUND ART

At present, filing devices such as files are generally constituted by one or more panels of material defining a back or spine and, on each side of the latter, two lateral faces, hinged in relation to the spine so as to be able to open and/or close the file.

The panel or panels of material is/are constituted by a solid wall, most often of cardboard and/or a synthetic material, the thickness of which varies but generally remains small, for example in the order of 0.5 mm to 2 mm.

Such files are of limited strength and quickly become damaged if used frequently, unless they are provided with reinforcements.

Furthermore, the materials used to form their walls are not generally of a satisfactory external appearance and thus have to be provided with a decorative covering.

The object of the present invention is to provide a filing device that remedies the aforementioned drawbacks and that is stronger, without, however, necessitating any reinforcements.

Another object of the invention is to provide a filing device that is easier to decorate, without having to be provided with a covering.

When the presently known files are manufactured, it is also found that their assembly necessitates numerous operations, as well as possible additional operations, in particular, as mentioned above, to improve their strength or their aesthetic appearance.

A further object of the present invention is to provide a process for manufacturing a filing device that limits the number of additional operations to be carried out and thus permits time saving.

Other objects and advantages of the present invention will emerge in the course of the description that follows, which is provided only by way of illustration and is not intended to limit same.

SUMMARY OF THE INVENTION

The present invention relates to a filing device, in particular for documents, such as sheets or pages, or others, possibly perforated, constituted by at least one panel of material, defining at least a back or spine and two lateral faces, characterised by the fact that the panel or panels is/are constituted by a planiform hollow shell, capable of imparting to the panel relatively substantial thickness and rigidity.

The present invention also relates to a process for the manufacture of a filing device such as the one described above, in particular for documents such as sheets or pages, or others, possibly perforated, constituted by at least one panel of material, defining at least a back or spine and two lateral faces, characterised by the fact that the panel or panels is/are produced by extrusion moulding a tube or sleeve of material and blow moulding the sleeve in such a way as to obtain a planiform hollow shell.

BRIEF DESCRIPTION OF THE DRAWINGS

The present invention will be more readily understood from a study of the following description, accompanied by the annexed drawings, which form an integral part thereof, and wherein.

DETAILED DESCRIPTION OF THE INVENTION

The present invention relates to a filing device, in particular for documents such as sheets or pages, or others, possibly perforated.

According to the different forms of embodiment illustrated, the device can be a file. According to other forms of embodiment, it could also be, for instance, a filing box, or box file.

Figure 1:
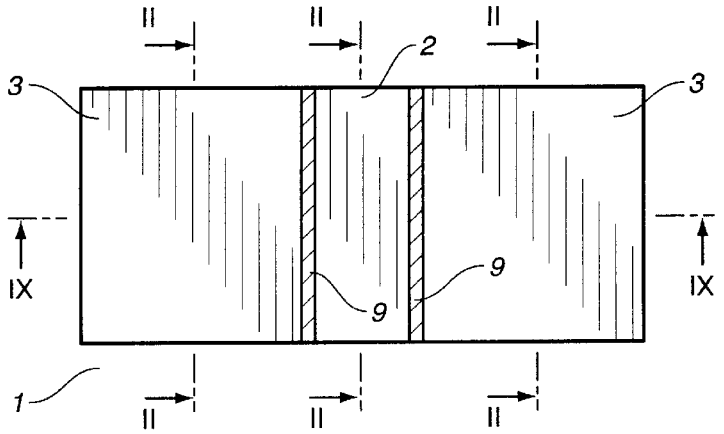
FIG. 1 is a front view of a first example of a filing device according to the invention, as spread out flat.

As shown in FIG. 1, the filing device according to the invention is constituted by at least one panel of material 1, defining at least a back or spine 2 and two lateral faces 3.

The panel or panels 1 is/are, in particular, substantially rectangular, as are the back or spine 2 and the said lateral faces 3. They have, for example, at least one identical dimension, corresponding to the height of the file, the lateral faces 3 being provided on either side of the spine 2.

Figure 2:
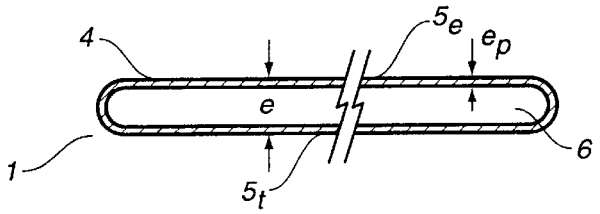
FIG. 2 is a cross-sectional view along lines II—II indicated in above FIG. 1.

With reference to FIG. 2, it will be noted that, according to the invention, the panel or panels 1 is/are constituted by a planiform hollow shell 4 which makes it possible to impart to the panel 1 a thickness, designated by e, and a rigidity that are relatively substantial. The thickness, for instance, can range from 3 mm to 5 mm.

The filing device according to the invention thus possesses enhanced strength without, however, using excessive quantities of material or using added reinforcements.

The shell 4 has, for example, a first wall, defining the outer side, $\mathbf{5}_e$, of the filing device, and a second wall, defining the inner side, $\mathbf{5}_i$, of the filing device, the first and second walls surrounding a closed inner cavity 6.

The expression 'hollow shell' is to be taken as meaning that, except by their peripheral edges, the outer and inner sides, $\mathbf{5}_e$ and $\mathbf{5}_i$, are not associated with one another. The cavity 6 does not, therefore, contain a layer of material, corrugated or otherwise, or spacers and/or other members, connecting the said sides $\mathbf{5}_e$, $\mathbf{5}_i$.

According to a first form of embodiment, corresponding to the one illustrated, the shell 4 is designed to be made in one piece and the first and second walls are in the continuation of one another without any discontinuity in the material.

According to another form of embodiment, not shown, the shell 4 can also be constituted, for instance, by at least two half-shells, each defining one of the first and second walls, secured to one another.

This being the case, the shell 4 has, for example, a thickness, designated by $e_p$, that is relatively small, for instance, in the order of a few tenths of a millimeter.

Figure 3:
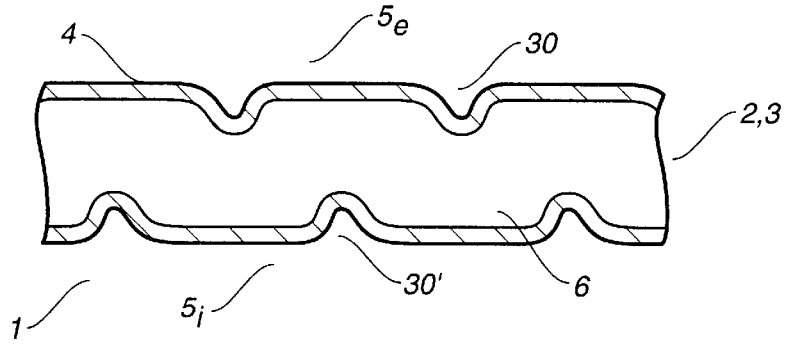
FIG. 3 partially reproduces above FIG. 2 with another example of a filing device according to the invention.

As shown in FIG. 3, inwardly and/or outwardly facing ribs 30, 30' can be provided on the shell 4, in particular to increase its rigidity. These are produced, for example in the body of the material by locally deforming sides $\mathbf{5}_e$, $\mathbf{5}_i$.

The said ribs 30, 30' are disposed, for example, parallel to one another in a longitudinal or transverse direction and/or according to any other pattern. They alternate, in particular, between sides $\mathbf{5}_e$ and $\mathbf{5}_i$, for example in a staggered fashion.

Figure 4:
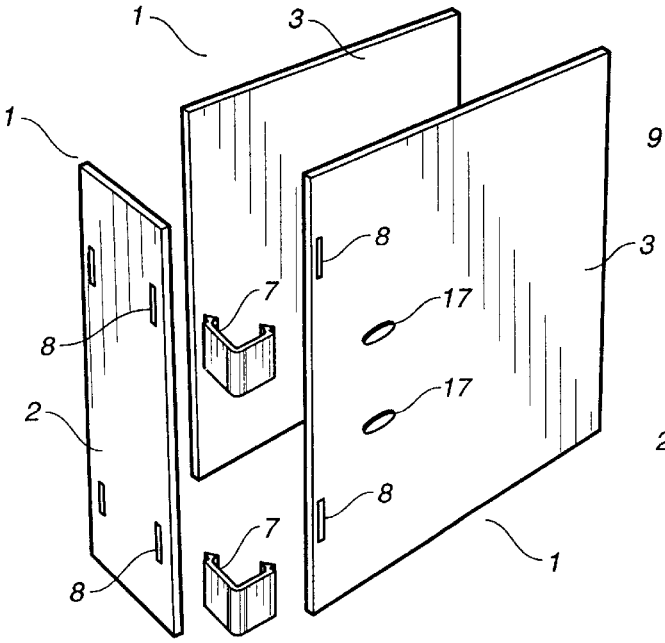
FIG. 4 is a perspective illustration of a first form of embodiment of a filing device such as a file according to the invention.

With reference to FIG. 4, it can be seen that, according to a first example, the filing device according to the invention is constituted by three panels 1 defining, respectively, the spine 2 and the said two lateral faces 3 of the filing device, the panels 1 being joined to one another by clips or fasteners 7 and/or by hinge means, not shown.

The fasteners 7 co-operate, in particular, with slits 8 provided facing one another on the panels 1 in the area of their common edges. As to the hinge means, these are provided, possibly, all along the edges.

According to a second example, corresponding to the other figures shown, the filing device according to the invention is constituted by a single panel 1 made in one piece.

Figure 9:
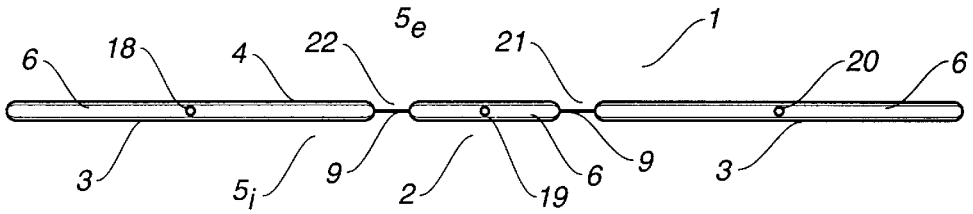
FIG. 9 is a cross-sectional view, along line IX—IX indicated in above FIG. 1, illustrating a form of embodiment of a process for the manufacture of a filing device according to the invention.

According to this example of embodiment, the panel 1 further defines, in particular, hinges 9 between the spine 2 and the lateral faces 3 of the filing device, the hinges 9 being constituted, as illustrated in FIG. 9, by the first and second walls, locally brought together in a direction transverse to the panel 1.

Figure 5:
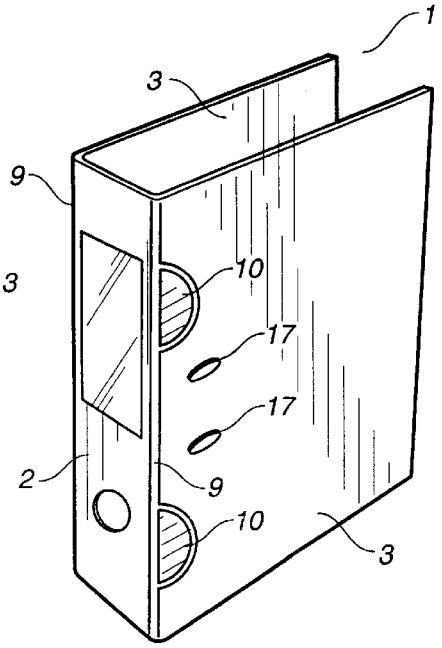
FIG. 5 is a perspective illustration of a second form of embodiment of a filing device according to the invention.
Figure 8:
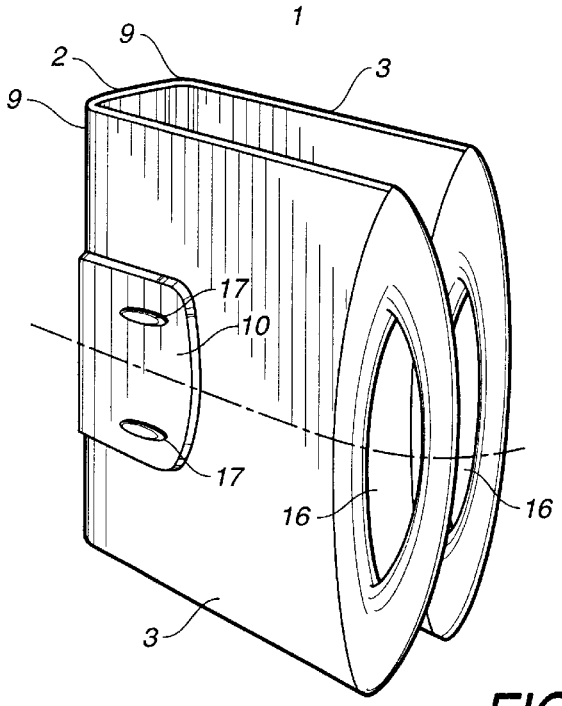
FIG. 8 is a perspective illustration of a fifth form of embodiment of a filing device according to the invention.

As shown in FIG. 5 or 8, the filing device according to the invention can further possibly have decorative patterns 10 constituted, in particular, by deformations of the material provided on the shell 4. The patterns 10 enable the aesthetic appearance of the file to be enhanced.

Figure 6:
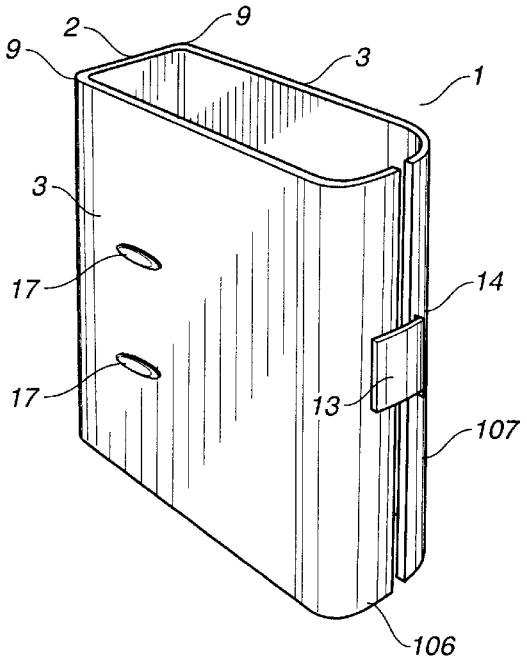
FIG. 6 is a perspective illustration of a third form of embodiment of a filing device according to the invention.
Figure 7:
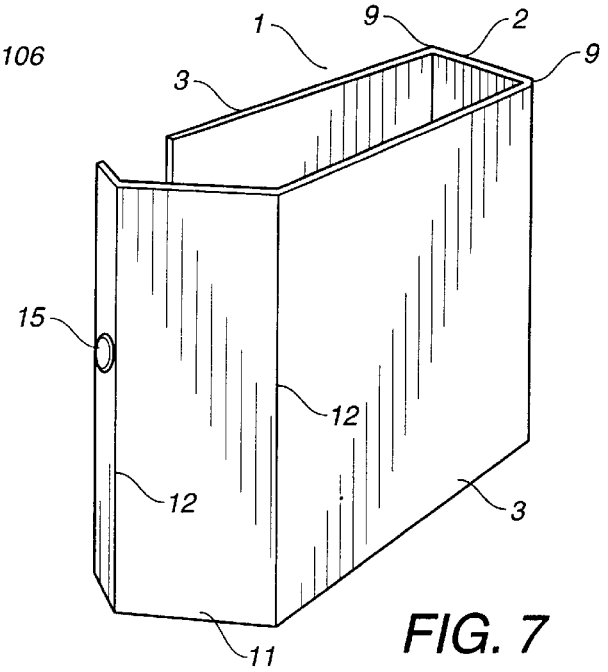
FIG. 7 is a perspective illustration of a fourth form of embodiment of a filing device according to the invention.

In FIGS. 6 and 7, it can be seen that the file can further have one or more flaps 106, 107; 11, defined in the panel 1, constituting extensions of at least one of the lateral faces 3.

The form of embodiment illustrated in FIG. 6 will be described in detail later.

According to the form of embodiment shown in FIG. 7, only one flap 11 is provided, the latter being articulated in relation to the corresponding lateral face 3 via a hinge 12, the structure of which is possibly the same as that of hinges 9 described earlier.

The flaps 106, 107; 11 make it possible, in particular, to improve the stability of the filing device and to ensure the spacing apart of its lateral faces 3.

The flaps 106, 107; 11 further permit integration of the means for closing the filing device, this being achieved easily and aesthetically, although such means could be provided elsewhere.

This being the case, the filing device possibly further includes means for transporting the filing device and/or means for attaching the products filed in the filing device.

According to the form of embodiment shown in FIG. 7, the closing means are constituted by a holding member such as, for example, a press stud or snap fastener 15, provided, on one hand, in the vicinity of the distal edge of flap 11 and, on the other hand, correspondingly, on the lateral face 3 opposite the lateral face 3 in the continuation of which is located the flap 11.

With reference to FIG. 8, it will be noted that the transport means are constituted, for example, by an orifice 16 provided in the neighborhood of the distal edges of the lateral faces 3 in such a way as for form handles, possibly rendered integral with one another by means of a clip, not shown.

According to other forms of embodiment, not shown, the transport means can be formed, in particular, by handles retractable through slits provided in the area of the hinges 9 separating the spine 2 and the lateral faces 3. They can also take the form, for example, of a handle hinged in a slit provided in the neighborhood of the upper edge of spine 2.

The attachment means, not shown, are constituted, for example, in a known manner, by rings secured to one of the lateral faces 3, or to the spine of the file, capable of opening or closing to enable the products filed in the filing device to be introduced and/or removed. Slits 17 are possibly provided facing each other on the other lateral face 3 in such a way as to enable the rings to emerge, at least partially, through the other lateral face 3 when the filing device is closed.

The filing device according to the invention can also, of course, be designed without an attachment mechanism.

This being the case, as already mentioned, the structure of the filing device according to the invention makes it possible to contemplate the form of embodiment illustrated, in particular, in FIG. 6 and discussed in fuller detail hereinafter.

One, at least, of the lateral faces 3 has, in the area of its distal end 104, 105, for example, flaps 106, 107 directed towards the other lateral face. The stability of the file in vertical position is thus ensured. The expression 'distal end' is to be taken as meaning the side opposite from the hinges 9 provided between the lateral faces 3 and the spine 2.

As illustrated, each lateral face 3 has, for example, a flap 106, 107, the flaps 106, 107 being designed to be convergent.

The term "convergent" is to be taken as meaning that each flap 106, 107 forms a bend in relation to its lateral face 3 in the direction of the flap 106, 107 located opposite on the other lateral face.

With more particular reference to FIG. 1, it will be noted that the flaps 106, 107, according to the example of embodiment illustrated, meet in the area of their distal edges 108, 109. The spacing apart of the lateral faces 3 of the file is thus ensured by the edge to edge contact of the flaps 106, 107.

The spacing apart can correspond, in particular, to the width of spine 2 of the file, that is to say to the dimension of spine 2 in the direction perpendicular to hinges 9 of the spine edges.

The flaps 106, 107 are provided, possibly, along their distal edges 108, 109, in their thickness, with shoulders 111 capable of co-operating with one another. The latter make it possible, for example, to improve the relative positioning of the lateral faces 3 when their flaps 106, 107 meet.

Figure 10:
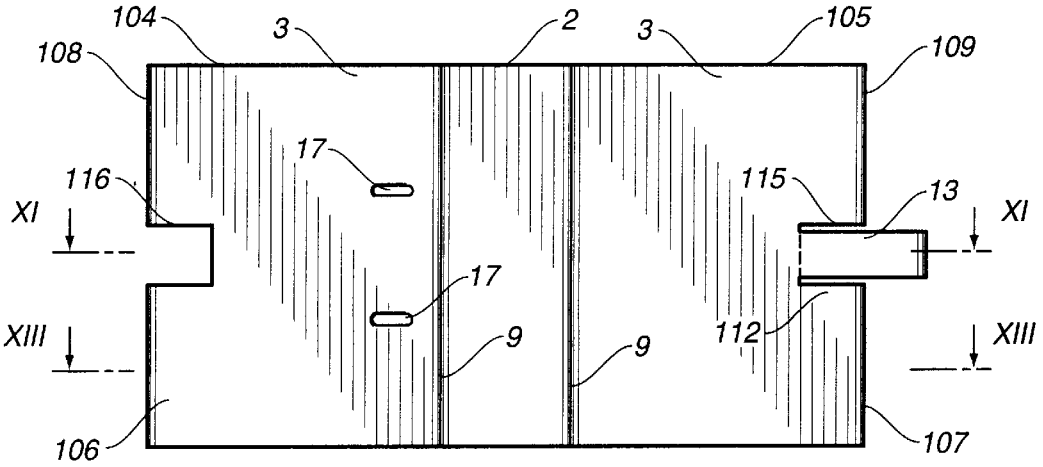
FIG. 10 is a front view of a second example of a filing device according to the invention, as spread out flat.

With further reference to FIG. 10, it will be noted that the spine 2 and the lateral faces 3 are, in particular, substantially rectangular and are of the same dimension in the direction parallel to the spine edges 9, thus defining, according to a first example, the height of the file.

As can be seen from FIG. 6, the flaps 106, 107 are provided, possibly, along the full length of the height. They can also be partial.

If, according to forms of embodiment different from those illustrated, the spine 2 and the lateral faces 3 should not be of the height, the height of the file could then be defined either by the dimension of the spine 2 or by the dimension of the lateral faces 3 in the direction of the spine edges 9. The height of the flaps 106, 107 could then correspond to one or the other of these two dimensions.

According to yet other forms of embodiment, the lateral faces 3 could also have flaps 106, 107 only partially along their distal ends.

This being the case, the flaps 106, 107 are, in particular, symmetrical. They have, for example, a profile that is curved and/or polygonal and/or defines a sharp angle in relation to the lateral faces 3.

According to the different forms of embodiment illustrated, the flaps 106, 107 are provided in the continuation of their lateral faces 3 and form with the latter a rigid assembly. This is to be taken as meaning that the flaps 106, 107 are not hinged in relation to the lateral faces 3.

As explained in greater detail herebelow, the flaps 106, 107 and the lateral faces 3 are possibly designed so as to be in one piece.

Figure 11:
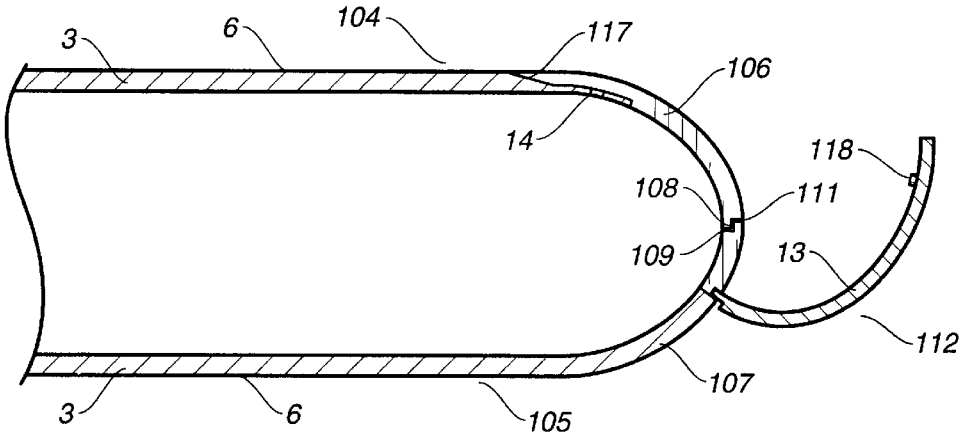
FIG. 11 is a partial cross-sectional view, along line XI—XI indicated in above FIG. 10, of the filing device, illustrated in closed position, in a first state.
Figure 12:
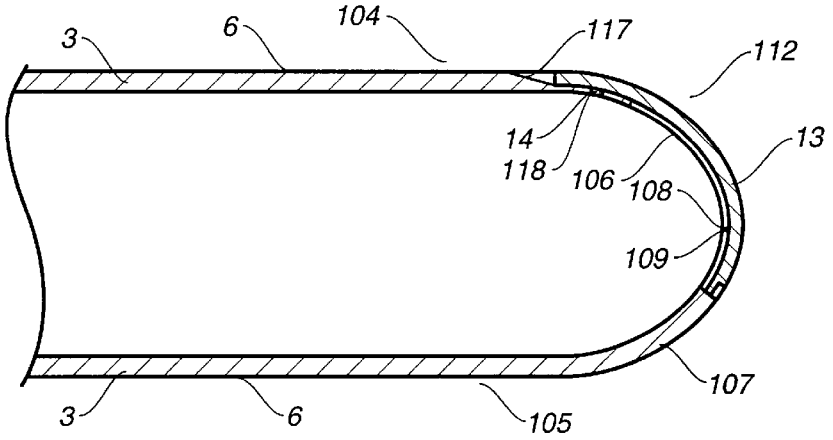
FIG. 12 is a view according to above FIG. 11, the file being in a second state.

With reference now to FIGS. 11 and 12, it will be noted that the flaps 106, 107 have, in particular, as mentioned earlier, means 112 for closing the filing device. These are, for example, a hook member 13, constituted, in particular, by a tab, provided on one of flaps 106, 107, termed the first flap 107, and a slit 14, provided on the other flap, termed the second flap 106, the hook member 13 and the slit 14 being capable of co-operating to ensure that the said flaps 106, 107 are held in relation to one another, or even between one another.

The hook member 13 may possibly have a certain degree of elasticity and, in particular, a profile that is substantially identical with that of the flaps 106, 107, so as to enable it to be placed under tension after introduction through the slit 14. Thus, when, as illustrated, the distal ends 108, 109 of the flaps 106, 107 meet, the placing of the hook member 13 makes it possible to improve the closing of the filing device, while blending harmoniously into the aesthetic appearance of the latter.

As shown in FIG. 10, the first flap 107 has, in particular, a first cut out portion 115, provided on the edge portion of its distal edge 109 and orientated orthogonally in relation to the distal edge 109. This first cut out portion defines the hook member 13 in the shape of a tab and its articulation in relation to the first flap 107 at the bottom of the first cut out portion 115.

Similarly, the second flap, 106, has, in particular, a facing second, U-shaped cut out portion 116, capable of receiving the hook member 13, the slit 14, not shown in FIG. 10, being provided so as to be orientated parallel to the bottom of the second cut out portion 116.

With further reference to FIGS. 11 and 12, it will be noted that the second flap 106 further possibly has, in its thickness, an oblique area 117, suitable for facilitating the opening of the file.

The hook member 13 is provided, for example, with a protuberance 118 capable of co-operating with the slit 14, provided in the mass of the second flap 106, or on a plate added on in the area of the inner side of the filing device.

According to other forms of embodiment, not shown, the hook member 13 is provided, in the area of its lateral edges, in its thickness, with protuberances, capable of co-operating with orifices provided in the thickness of the second flap 106, in the area of the lateral edges of the second U-shaped cut out portion 116.

This being the case, although these are no longer needed to ensure the stability of the file and the spacing apart of its lateral faces 3, slits 17 can be provided, as mentioned earlier, on one of the lateral faces 3 to co-operate with attachment means, possibly constituted by rings provided in the filing device.

The height of the attachment means is adjusted, in particular, via a recess of greater or lesser depth, provided in lateral face 3, to which the attachment means are possibly secured, the recesses being capable of receiving the attachment means.

Furthermore, as mentioned earlier, the lateral faces 3 and the flaps 106, 107 are possibly made in one piece, as well as, in particular, the hook member 13.

In this connection, the present invention also relates to a process for manufacturing a filing device such as the one described above, constituted by at least one panel of material 1, defining at least a spine 2 and two lateral faces 3.

Figure 13:
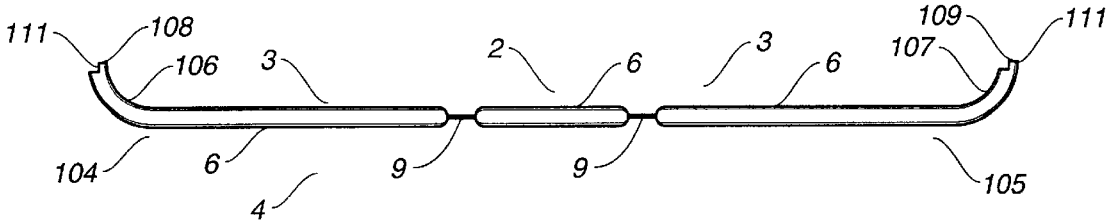
FIG. 13 is a cross-sectional view along line XII—XII indicated in above FIG. 10.

According to the invention, as illustrated in FIGS. 9 or 13, the panel or panels 1 is/are produced by extrusion moulding a sleeve of material and blow molding the sleeve so as to obtain a planiform hollow shell 4.

The sleeve is formed, for example, continuously, and a length thereof, corresponding to the height of the filing device, is introduced into a mold. At least one air blowing duct is introduced into the sleeve and the mold is closed.

Air is then introduced via the said duct into the mold, which has the effect of pressing the walls of the sleeve against the walls of the mold and of thus forming the sleeve 4 constituting the panel of material 1.

With reference to FIG. 9, it will be noted that the said hinges 9 are produced, for example, by blow molding the sleeve simultaneously at at least three different blow molding points 18–20, separated by constrictions 21, 22, provided in the mold facing the locations of the hinges 9.

The process according to the invention thus makes it possible to reduce additional operations. Any slits, 8, 14, 17, orifices 16, decorative patterns 10, flaps 11; 106, 107, ribs 30, 30' and/or hinges 9, 12 can, in fact, be produced directly at the time of extrusion and blow molding of panel 1, for example in the body of the material.

Decorative patterns 10 and/or ribs 30, 30' are obtained, for example, using patterns provided in facing areas in the mold.

The different materials that can be used, for example, are polypropylene and/or polyethylene and/or, in general, any material that can be fashioned using the extrusion-blow molding process.

Other forms of embodiment, within the grasp of a man of the art, could, of course, have been contemplated without thereby departing from the scope of the invention.

I claim:

1. A filing device for documents comprising at least one panel of material defining a spine and a first lateral face extending from one side of said spine and a second lateral face extending from another side of said spine, said panel being a planiform hollow shell, a first flap formed at a distal end of said first lateral face from said spine, a second flap formed at a distal end of said second lateral face from said spine, said first flap having a distal edge from said first lateral face, said second flap having a distal edge from said second lateral face, said first and second flaps meeting at the respective distal edges so as to space apart said first and second lateral faces, said first and second flaps having closure means thereon for closing the filing device, said closure means comprising a hook member formed on said first flap and a slit formed on said second flap, said hook member being cooperative with said slit, said hook member having an elasticity suitable for placing said hook member under tension when received within said slit, said first flap having a cut-out portion formed in said distal edge of said first flap and oriented orthogonally to said distal edge of said first flap, said hook member being in hinged relation to said first flap at a bottom of said cut-out portion of said first flap, said second flap having a U-shaped cut-out portion adapted to receive said hook member, said slit oriented parallel to a bottom of said cut-out portion of said second flap.

2. The device according to claim 1, wherein shell has a first wall defining an outer side of the filing device, and a second wall defining an inner side of the filing device, said first and second walls surrounding a closed inner cavity, said shell being of unitary construction.

3. The device according to claim 1, wherein said spine and said first and second lateral faces are joined together by fasteners.

4. The device according to claim 2, said at least one panel of material being a single panel, of unitary construction.

5. The device according to claim 4, wherein said panel further defines hinges between the spine and the lateral faces, said hinges being defined by said first and second walls in a direction transverse to said panel.

6. The device according to claim 1, further comprising decorative patterns formed by deformations in the material of said shell.

7. The device according to claim 1, wherein said flaps have shoulders formed along said distal edges, in their thickness with shoulders cooperative with one another.

8. The device according to claim 1, wherein each of said flaps has a profile that is either curved or polygonal or defines a sharp angle in relation to the respective lateral faces.

9. The device according to claim 1, wherein said flaps and said lateral faces are of unitary constitutions.

* * * * *